US005433752A

United States Patent [19]

Birkhofer et al.

[11] Patent Number: 5,433,752

[45] Date of Patent: Jul. 18, 1995

[54] USE OF RECTION PRODUCTS OF HOMO- OR COPOLYMERS BASED ON MONOETHYLENICALLY UNSATURATED DICARBOXYLIC ANHYDRIDES WITH AMINES OR ALCOHOLS FOR FATLIQUORING AND FILLING LEATHER AND FUR SKINS

[75] Inventors: Hermann Birkhofer; Peter Danisch, both of Ludwigshafen; Walter Denzinger, Speyer; Heinrich Hartmann, Limburgerhof; Norbert Greif, Bobenheim; Knut Oppenlaender, Ludwigshafen, all of Germany

[73] Assignee: BASF Aktiengesellschaft, Ludwigshafen, Germany

[21] Appl. No.: 290,779

[22] PCT Filed: Feb. 15, 1993

[86] PCT No.: PCT/EP93/00354

§ 371 Date: Aug. 26, 1994

§ 102(e) Date: Aug. 26, 1994

[87] PCT Pub. No.: WO93/17130

PCT Pub. Date: Sep. 2, 1993

[30] Foreign Application Priority Data

Feb. 26, 1992 [DE] Germany ..... 42 05 839.2

[51] Int. Cl.[6] ..... C14C 3/22; C14C 9/02

[52] U.S. Cl. ..... 8/94.21; 8/94.22; 252/8.57; 525/327.6; 525/327.7

[58] Field of Search ..... 525/327.4, 327.6, 327.7; 252/8.57; 8/94.14, 94.21, 94.33, 94.22

[56] References Cited

U.S. PATENT DOCUMENTS

| | | | |
|---|---|---|---|
| 2,452,536 | 11/1948 | Kirk . | |
| 2,746,837 | 5/1956 | Kirk | 8/94.21 |
| 4,048,422 | 9/1977 | Sackmann | 526/272 |
| 5,124,181 | 6/1992 | Schaffer | 427/323 |
| 5,279,613 | 1/1994 | Schaffer | 8/94.1 R |

*Primary Examiner*—David Buttner

*Attorney, Agent, or Firm*—Oblon, Spivak, McClelland, Maier & Neustadt

[57] ABSTRACT

Products useful for fatliquoring and filling leather and fur skins are obtained on reacting A) homo- or copolymers based on monoethylenically unsaturated dicarboxylic anhydrides and obtainable by free-radically initiated polymerization of a) from 30 to 100 mol % of one or more monoethylenically unsaturated dicarboxylic anhydrides of from 4 to 10 carbon atoms, b) from 0 to 70 mol % of one or more aromatic vinyl compounds of the general formula I

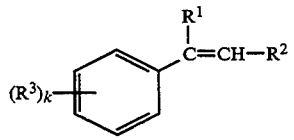

I where $R^1$, $R^2$ and $R^3$ are each hydrogen, methyl or ethyl and k is 1 or 2, (c) from 0 to 70 mol % of one or more vinyl esters of $C_1$- to $C_8$-carboxylic acids, (d) from 0 to 50 mol % of one or more $C_2$- to $C_6$-olefins, and (e) from 0 to 30 mol % of one or more monoethylenically unsaturated $C_3$- to $C_5$-carboxylic acids, which mixture of monomers (a) to (e) may additionally contain up to 10% by weight of further copolymerizable monomers, with B) amines of the general formula $R_4R_5NH$, where $R^4$ is hydrogen, $C_1$- to $C_{20}$-alkyl, $C_5$- to $C_8$-cycloalkyl or $C_2$- to $C_4$-hydroxyalkyl and $R^5$ is $C_6$- to $C_{30}$-alkyl, $C_6$- to $C_{30}$-alkenyl, $C_5$- to $C_8$-cycloalkyl or $C_2$- to $C_4$-hydroxyalkyl, or alcohols of the general formula $R^6—O—(C_mH_{2m}O)_p—(C_nH_{2n}O)_q—H$, where $R^6$ is $C_1$- to $C_{30}$-alkyl, $C_2$- to $C_{30}$-alkenyl, $C_5$- to $C_8$-cycloalkyl or—if $p+q>0$—hydrogen, m and n are each from 2 to 4 and p and q are each from 0 to 50, or mixtures of such amines and alcohols.

8 Claims, No Drawings

USE OF RECTION PRODUCTS OF HOMO- OR COPOLYMERS BASED ON MONOETHYLENICALLY UNSATURATED DICARBOXYLIC ANHYDRIDES WITH AMINES OR ALCOHOLS FOR FATLIQUORING AND FILLING LEATHER AND FUR SKINS

The present invention relates to the use of reaction products of homo- or copolymers based on monoethylenically unsaturated dicarboxylic anhydrides with amines and alcohols for fatliquoring and filling leather and fur skins. The invention also relates to leather treatment compositions containing these reaction products.

To control the mechanical properties of leather, such as softness, flexibility or suppleness, it is common practice to employ aqueous fat emulsions (fat liquors) which are generally based on petrochemically produced or natural oils and fats. These oils and fats are in general rendered emulsifiable in water by partial sulfonation or by means of emulsifiers. Disadvantages of this class of fatliquoring agents are incomplete liquor exhaustion, relative ease of extraction by solvents or water, the occurrence of migration phenomena and unsatisfactory fastness profiles.

Polymeric products, based for example on unsaturated dicarboxylic acid derivatives and long chain olefins, that have fatliquoring properties for leather and fur skins are known and find utility as water repellents for leather and fur skins.

For instance, EP-A-412 389 recommends the use as water repellents for leather and fur skins of copolymers of $C_8$- to $C_{40}$-monoolefins and ethylenically unsaturated $C_4$- to $C_8$-dicarboxylic anhydrides, converted into aqueous solutions or dispersions by solvolysis of the anhydride groups, for example with bases such as amines, or partial esterification of the anhydride groups with alcohols and at least partial neutralization of the resulting carboxyl groups with bases in an aqueous medium.

Polymeric fatliquoring agents of this type do have some effect, but they are not entirely satisfactory for soft kinds of leather. Soft leathers require an additional, native or synthetic fat liquor that complements the action of the polymeric agent.

It is an object of the present invention to provide an improved fatliguoring and filling agent for leather and fur skins that is free of the prior art disadvantages.

We have found that this object is achieved by using reaction products of

A) homo- or copolymers based on monoethylenically unsaturated dicarboxylic anhydrides and obtainable by free-radically initiated polymerization of
   a) from 30 to 100 mol % of one or more monoethylenically unsaturated dicarboxylic anhydrides of from 4 to 10 carbon atoms,
   b) from 0 to 70 mol % of one or more aromatic vinyl compounds of the general formula I

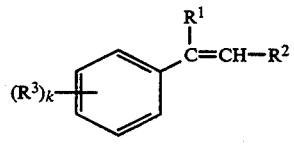

I where $R^1$, $R^2$ and $R^3$ are each hydrogen, methyl or ethyl and, k is 1 or 2, c) from 0 to 70 mol % of one or more vinyl esters of $C_1$- to $C_8$-carboxylic acids,
   d) from 0 to 50 mol % of one or more $C_2$- to $C_6$-olefins, and
   e) from 0 to 30 mol % of one or more monoethylenically unsaturated $C_3$- to $C_5$-carboxylic acids, which mixture of monomers (a) to (e) may additionally contain up to 10% by weight of further copolymerizable monomers, with B) amines of the general formula $R^4R^5NH$, where $R^4$ is hydrogen, $C_1$- to $C_{20}$-alkyl, $C_5$- to $C_8$-cycloalkyl or $C_2$- to $C_4$-hydroxyalkyl and $R^5$ is $C_6$- to $C_{30}$-alkyl, $C_6$-to $C_{30}$-alkenyl, $C_5$- to $C_8$-cycloalkyl or $C_2$- to $C_4$-hydroxyalkyl, or alcohols of the general formula $R_6$-Q-$(C_mH_{2m}O)_p$-$(C_nH_{2n}O)_q$-H, where $R^6$ is $C_1$- to $C_{30}$-alkyl, $C_2$- to $C_{30}$-alkenyl, $C_5$- to $C_8$-cycloalkyl or—if $p+q>0$—hydrogen, m and n are each from 2 to 4 and p and q are each from 0 to 50, or mixtures of such amines and alcohols, for fatliquoring and filling leather and fur skins.

Suitable monoethylenically unsaturated dicarboxylic anhydrides of from 4 to 10 carbon atoms (a) are in particular maleic anhydride, itaconic anhydride, citraconic anhydride, mesaconic anhydride, methylenemalonic anhydride and mixtures thereof. Maleic anhydride is particularly preferred.

In the general formula I for the aromatic vinyl compounds (b), $R^1$ is preferably hydrogen or methyl, $R^2$ and $R^3$ are each preferably hydrogen and k is preferably 1. If when k is 1 $R^3$ is methyl or ethyl, it is preferably in the para position. If when k is 2 $R^3$ is methyl or ethyl, the substitution pattern on the phenyl is preferably 2,4.

Suitable aromatic vinyl compounds (b) are in particular styrene, α-methylstyrene and a mixture thereof.

Suitable vinyl esters (c) are in particular vinyl esters of $C_1$- to $C_4$-carboxylic acids, e.g. vinyl formate, vinyl propionate, vinyl butyrate or in particular vinyl acetate. Mixtures of such vinyl esters can also be used.

Suitable $C_2$- to $C_6$-olefins (d) are in particular straight-chain or branched monoolefins, in particular α-olefins, e.g. ethylene, propylene, 1-butene, isobutene, 1-pentene or 1-hexene, also 2-butene, 2-pentene, 2-hexene or 3-hexene. Isobutene is particularly preferred. It is also possible, however, to use conjugated dienes such as butadiene or isoprene. Similarly, mixtures of said olefins can be used.

Suitable monoethylenically unsaturated carboxylic acids (e) are in particular $C_3$- or $C_4$-carboxylic acids, e.g. crotonic acid or in particular acrylic acid and methacrylic acid.

Useful products are homopolymers A of a monomer (a), copolymers A of two or more monomers (a) and copolymers A of monomers (a) to (e), in which case, however, the copolymer must contain at least 30 mol % of monoethylenically unsaturated dicarboxylic anhydride (a). For instance, a useful copolymer composition is 60 mol % of styrene, 30 mol % of maleic anhydride and 10 mol % of acrylic acid, or else 50 mol % of maleic anhydride, 25 mol % of styrene and 25 mol % of vinyl acetate.

In a preferred embodiment, component A in the preparation of the reaction products used according to the invention is a homopolymer of a monoethylenically unsaturated dicarboxylic anhydride of from 4 to 10 carbon atoms (a).

In a further preferred embodiment, component A in the preparation of the reaction products used according to the invention is a copolymer of (a) from 30 to 99 mol % of a monoethylenically unsaturated dicarboxylic anhydride of from 4 to 10 carbon atoms, and (b) from 1 to 70 mol % of one or more aromatic vinyl compounds I.

In a further preferred embodiment, component A in the preparation of the reaction products used according to the invention is a copolymer of (a) from 30 to 99 mol % of a monoethylenically unsaturated dicarboxylic anhydride of from 4 to 10 carbon atoms, and (c) from 1 to 70 mol % of one or more vinyl esters of $C_1$- to $C_8$-carboxylic acids.

In a further preferred embodiment, component A in the preparation of the reaction products used according to the invention is a copolymer of (a) from 50 to 99 mol % of a monoethylenically unsaturated dicarboxylic anhydride of from 4 to 10 carbon atoms, and (d) from 1 to 50 mol % of one or more $C_2$- to $C_6$-olefins.

To achieve further modification of the properties of the polymers A it is possible to use in addition small amounts of further monomers copolymerizable with the monomers (a) to (e), in particular monoethylenically and polyethylenically unsaturated compounds. These are for example hydroxyalkyl esters having from 2 to 6 carbon atoms in the alkyl moiety and the corresponding nitriles of the aforementioned mono- and dicarboxylic acids, N-vinylamides such as, for example, N-vinylacetamide, N-vinylpyrrolidone, N-vinylpiperidine, N-vinylcaprolactam, N-vinylsuccinimide, N-vinylphthalimide, N-vinyloxazolone, N-vinylformamide and N-vinylimidazole and also alkyl vinyl ethers having from 1 to 18 carbon atoms in the alkyl moiety, for example methyl vinyl ether, ethyl vinyl ether or stearyl vinyl ether, and $C_8$- to $C_{30}$-olefins, in particular $C_{10}$- to $C_{20}$-$\alpha$-olefins, for example 1-dodecene, 1-hexadecene or 1-octadecene. Also suitable are methylenebisacrylamide, esters of acrylic acid, methacrylic acid and maleic acid with polyhydric alcohols, for example glycol diacrylate, glycerol triacrylate, glycol dimethacrylate, glycerol trimethacrylate, and also at least doubly acrylated or methacrylated polyols such as pentaerythritol and glucose. It is also possible to use divinylbenzene, divinyldioxane, pentaerythritol triallyl ether, pentaallylsucrose and also glycol diacrylates of polyethylene glycols having molecular weights up to 3000. These modifying monomers for the polymers A are added to the monomer mixture of (a) to (e) in amounts of up to 10% by weight, preferably up to 5% by weight.

The polymers A can be prepared by conventional free radical polymerization. Especially the techniques of suspension, solution and bulk polymerization can be employed. Examples of diluents or solvents used for the polymerization are organic solvents such as toluene, xylene, ethylbenzene, isopropylbenzene, tetrahydrofuran, dioxane, cyclohexane, petroleum ethers or naphtha. The reaction is carried out under atmospheric or superatmospheric pressure. Suitable free radical initiator systems are all those which form free radicals under the desired polymerization conditions, for example di-tert-butyl peroxide, tert-butyl perbenzoate or tert-butyl perethylhexanoate. It is possible, in particular in the case of suspension polymerization, to add protective colloids such as polyethyl vinyl ether.

The K values of the polymers A are in general within the range from 6 to 200, in particular from 8 to 100. The K values of the copolymers were determined by the method of Fikentscher on 1% strength by weight solutions in cyclohexanone and the K values of the homopolymers (a) in dimethylformamide as solvent at 25° C.

The as-synthesized polymers A can be isolated in the solid form, dried if desired, and then reacted with component B. However, the polymers A can also be reacted directly in solution with component B.

Suitable alcohols of component B for reaction with the polymers A are in particular primary, secondary and tertiary alcohols of from 1 to 30 carbon atoms. It is possible to use not only saturated aliphatic alcohols but also unsaturated alcohols, for example oleyl alcohol. Preference is given to primary or secondary alcohols, e.g. amyl alcohol, n-hexanol, n-octanol, 2-ethylhexanol, n-nonanol, isononanol, n-decanol, n-dodecanol, n-tridecanol, isotridecanol, cyclohexanol, naturally occurring fatty alcohols such as tallow fat alcohol or stearyl alcohol and also the industrially readily obtainable oxo process alcohols or alcohol mixtures of from 9 to 19 carbon atoms, for example $C_{16/10}$ oxo alcohol, $C_{13/15}$ oxo alcohol, and also Ziegler alcohols of from 12 to 24 carbon atoms, e.g. $C_{12/14}$ or $C_{16/18}$ cuts.

The alcohols of component B can also be present as alkoxylates, ie. as reaction products with a $C_2$- to $C_4$-alkylene oxide such as ethylene oxide, propylene oxide or butylene oxide. In this case the molecule may contain one or two different alkylene oxide blocks. A suitable alkylene unit for such a block also includes tetramethylene as the polytetrahydrofuran structure.

Other suitable alcohols for use as component B are ether alcohols and polyetherdiols such as ethylene glycol monobutyl ether, di- and triethylene glycol monobutyl ether, polytetrahydrofuran and also polyethylene glycols and polypropylene glycols.

In a preferred embodiment, component B in the preparation of the reaction products used according to the invention comprises alcohols where $R^6$ is $C_1$- to $C_{22}$-alkyl or $C_{10}$- to $C_{22}$-alkenyl, m and n are each from 2 to 4 and p and q are each from 0 to 35.

Suitable primary or secondary amines of component B for reaction with the polymers A are for example n-hexylamine, cyclohexylamine, methylcyclohexylamine, 2-ethylhexylamine, n-octylamine, n-tridecylamine, isotridecylamine, tallow fat amines, stearylamine, oleylamine, di-n-hexylamine, dicyclohexylamine, di(methylcyclohexyl)amine, di(2-ethylhexyl)amine, di(n-octyl)amine, di(isotridecyl)amine, ditallowamine, distearylamine, dioleylamine, diethanolamine, di-n-propanolamine and diisopropanolamine.

In a preferred embodiment, component B in the preparation of the reaction products used according to the invention comprises amines where $R^4$ is hydrogen and $R^5$ is $C_{10}$- to $C_{22}$-alkyl or $C_{10}$- to $C_{22}$-alkenyl.

The reaction of polymers A with the amines or alcohols B is carried out in a conventional manner and generally involves the introduction of carboxylic ester or carboxamide functions into the polymers A. Amines are advantageously reacted with the polymers A under atmospheric or superatmospheric pressure at about 60°–130° C. in the absence of a solvent or in inert organic solvents such as toluene, xylene, cyclohexane, petroleum ether or naphtha customarily present from the preparation of the polymers A themselves. The reaction of the alcohols with the polymers A is advantageously likewise carried out in the absence of a solvent or preferably in inert organic solvents such as those mentioned above in the presence of acidic catalysts such as p-toluenesulfonic acid under atmospheric or superatmospheric pressure at about 100°–150° C.

The ratio between the components A and B in the reaction is customarily chosen in such a way that from 0.2 to 1.0 mol of amine or alcohol B or a mixture thereof is used per mole of monomer a) within the polymer A.

After the reaction between components A and B has ended, it is customary to remove any organic solvent present, preferably by distillation, and to disperse the product in an aqueous solution of a base, preferably of an alkali metal hydroxide such as sodium hydroxide or potassium hydroxide or ammonia, in order that the remaining anhydride functions of the partially esterified or amidated polymers may be partially or completely hydrolyzed and partially or completely neutralized.

The polymer dispersions thus obtainable are suitable for treating any conventional tanned hide. Tanned hides are customarily neutralized prior to the treatment. They may have already been dyed prior to the treatment. However, dyeing may also be delayed until after the fatliquoring of the invention.

The tanned hides are advantageously treated with the aqueous dispersions in an aqueous liquor at pH 4–10, preferably pH 5–8, and 20°–60° C., preferably 30°–50° C., for 0.1–5 hours, in particular 0.5–2 hours. This treatment may take the form for example of drumming. The amount of reaction product of A and B required is, based on the shaved weight of the leather or the wet weight of the fur skin, from 0.1 to 30% by weight, preferably from 1 to 20% by weight. The liquor length, ie. the percentage weight ratio of treatment liquor to goods, based on the shaved weight of the leather or the wet weight of the fur skin, is customarily from 10 to 1000%, preferably from 30 to 150%, in the case of fur skins from 50 to 500%. The dispersions used of the reaction products of A and B generally do not contain any additional emulsifiers.

After the treatment with the aqueous liquor described, the pH of the treatment liquor is adjusted with acids, preferably organic acids such as formic acid, to pH 3–5, preferably 3.5–4.

If customary retanning agents are additionally employed in the finishing process on the leather or fur skin, the treatment with the reaction products of A and B to be used according to the invention can be carried out before or after the retanning operation.

The present invention further provides leather treatment agents comprising reaction products of A) homo- or copolymers based on monoethylenically unsaturated dicarboxylic anhydrides and obtainable by free radical polymerization of
   a) from 30 to 100 mol % of one or more monoethylenically unsaturated dicarboxylic anhydrides of from 4 to 10 carbon atoms,
   b) from 0 to 70 mol % of one or more aromatic vinyl compounds of the general formula I

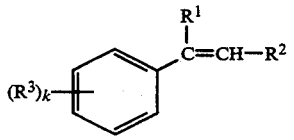

I where $R^1$, $R^2$ and $R^3$ are each hydrogen, methyl or ethyl and k is 1 or 2, c) from 0 to 70 mol % of one or more vinyl esters of $C_1$- to $C_8$-carboxylic acids,
   d) from 0 to 50 mol % of one or more $C_2$- to $C_6$-olefins, and
   e) from 0 to 30 mol % of one or more monoethylenically unsaturated $C_3$- to $C_5$-carboxylic acids, which mixture of monomers (a) to (e) may additionally contain up to 10% by weight of further copolymerizable monomers, with B) amines of the general formula $R^4R^5NH$, where $R^4$ is hydrogen, $C_1$- to $C_{20}$-alkyl, $C_5$- to $C_8$-cycloalkyl or $C_2$- to $C_4$-hydroxyalkyl and $R^5$ is $C_6$- to $C_{20}$-alkyl, $C_6$-to $C_{30}$-alkenyl, $C_5$- to $C_8$-cycloalkyl or $C_2$- to $C_4$-hydroxyalkyl, or alcohols of the general formula $R^6—O—(C_mH_{2m}O)_p—(C_nH_{2n}O)_q—H$, where $R^6$ is $C_1$- to $C_{30}$-alkyl, $C_2$- to $C_{30}$-alkenyl, $C_5$- to $C_8$-cycloalkyl or—if $p+q>0$—hydrogen, m and n are each from 2 to 4 and p and q are each from 0 to 50, or mixtures of such amines and alcohols.

The reaction products to be used according to the invention make it possible to prepare very soft leather without the addition of conventional fat liquors. This advantage is reflected in simple and short application recipes.

As well as improving the mechanical properties such as tensile strength these polymeric fatliquoring agents bring about a distinct enhancement in the fastness profile of the leather. For instance, they have a very positive effect on the light fastness and thermal yellowing resistance of such leathers. In addition to producing a virtually quantitative exhaustion of the liquor the good fixation in the leather yields great resistance to extractability with solvents or water. This results in washable leathers, i.e. leathers which on washing do not lose their properties such as softness, firmness and suppleness, unlike leathers fatliquored with conventional fat liquors.

Suitable choice of the specific alcohols and amines of component B in the reaction products used according to the invention makes it possible to vary the hydrophobic properties of these polymeric fatliquoring agents in such a way that the leather may also be given a certain water resistance.

A further advantage of the reaction products used according to the invention is that dispersions produced therefrom do not require any additional emulsifiers for application to leather or fur skin. Leathers and furs treated with emulsifier-containing products must afterwards be subjected in many cases to expensive processes, for example aftertreatment with polyvalent metal salts, in order to render the emulsifiers ineffective within the leather or fur skin.

EXAMPLES

The percentages in the examples are by weight, unless otherwise stated. The molecular weights of the copolymers were determined by gel permeation chromatography using tetrahydrofuran as mobile phase and narrow fractions of polystyrene for calibration. The Fikentscher K values were determined on 1% strength by weight solutions at 25° C. in cyclohexanone in the case of the copolymers and auxiliaries and in dimethylformamide instead of cyclohexanone in the case of the homopolymers of the monomers (a).

Preparation of polymers A

EXAMPLE 1

In a heatable reactor equipped with stirrer, reflux condenser, thermometer, addition means and nitrogen inlet and outlet means 1600 g of technical grade xylene, 392 g (4.0 mol) of maleic anhydride and 7 g of polyethyl vinyl ether having a K value of 50 were heated to the boil and 344 g (4.0 mol) of vinyl acetate and a solution of 4 g of di-tert-butyl peroxide in 200 g of technical grade xylene were metered in under boiling conditions at uniform rates over 2 hours. Thereafter the reaction mixture was stirred under reflux for one hour and cooled, the finely suspended polymer was filtered off, and the filter cake was dried to 80° C. under reduced pressure. The K value of the copolymer, present in the form of a white powder, was 15.9, and the molecular weight was 7000.

EXAMPLE 2

In a reactor as in Example 1 1960 g of o-xylene, 441 g (4.5 mol) of maleic anhydride and 45 g of polyethyl vinyl ether having a K value of 50 were heated to the boil and 468 g (4.5 mol) of styrene and a solution of 18.2 g of tert-butyl perbenzoate in 162 g of o-xylene were metered in under boiling conditions at uniform rates over 3 hours. This was followed by further heating for 2 hours and then cooling. The. K value of the polymer obtained was 14.6 and the molecular weight was 5000. The light brown, fine suspension having a polymer content of 29.5% was directly further processible into a leather fatliquoring agent.

EXAMPLE 3

The preparation was carried out similarly to Example 2, except that in this case 264.6 g (2.7 mol) of maleic anhydride and 655.2 g (6.3 mol) of styrene were used. The K value of the polymer obtained was 16.0 and the molecular weight was 9000. The fine, light brown polymer suspension was directly further processible into a leather fatliquoring agent.

EXAMPLE 4

In a reactor as in Example 1 1750 g of maleic anhydride and 1165 g of o-xylene were heated to the boil and a solution of 262 g of tert-butyl perethylhexanoate in 190 g of o-xylene was metered in under boiling conditions at a uniform rate over 5 hours. Thereafter the reaction mixture was heated for a further hour and then the o-xylene was decanted off the melt, and the melt was poured onto an aluminum tray and cooled. The resin was comminuted and the remaining solvent was distilled off under reduced pressure. The polymer had a K value of 10 and the molecular weight was 1000.

EXAMPLE 5

A pressure reactor equipped as described in Example 1 was charged with 1210 g of o-xylene, 636 g (6.5 mol) of maleic anhydride and 6 g of polyethyl vinyl ether having a K value of 50. The reactor was tightly sealed, then injected three times with nitrogen to 3 bar and let down again each time, evacuated and heated to 120° C. Thereafter 364 g (6.5 mol) of isobutene and a solution of 30 g of tert-butyl perethylhexanoate in 250 g of o-xylene were metered in at 120° C. over 4 hours at uniform rates. This was followed by heating at 120° C. for a further 2 hours. Then the pressure, which had built up to 3 bar, was let down and the reactor was cooled. The viscous, finely granular suspension of the copolymer was stripped of solvent at 80° C. under reduced pressure. The copolymer obtained was a fine powder having a K value of 25 and its molecular weight was 8000.

Preparation of dispersions of reaction products of A and B

The reaction products of polymers A and amines B were prepared by adding the a mines specified in the table to the polymers specified in the table in xylene at from 120° to 130° C. in the molar ratio of amine:maleic anhydride (MA) in the polymer specified in the table. After the reaction ended, the xylene was distilled off and the product was dispersed with an Ultraturax stirrer in aqueous sodium hydroxide solution in the molar ratio of NaOH:MA in the polymer specified in the table to produce a 20–25% strength dispersion having a pH of from 7 to 8.

The reaction products of polymers A and alcohols B were prepared by reaction of the alcohols specified in the table with the polymers specified in the table in xylene at from 120° to 130° C. in the presence of catalytic amounts of p-toluenesulfonic acid during 3–5 hours in the molar ratio of alcohol:MA in the polymer specified in the table. After the reaction had ended, the xylene was distilled off and the product was dispersed with an Ultraturax stirrer in aqueous sodium hydroxide solution in the molar ratio of NaOH:MA in the polymer specified in the table to produce: a 20–25% strength dispersion having a pH of from 7 to 8.

TABLE

Dispersions of reaction products of A and B

| Ex. No. | Polymer A of Ex. No. | Polymer composition (mol %) | Amine/Alcohol B (mol per mole of MA) | NaOH per (mol mole of MA) |
|---|---|---|---|---|
| 6 | 1 | MA/vinyl acetate 50/50 | Tallow fat alcohol 0.75 | 0.75 |
| 7 | 2 | MA/styrene 50/50 | $C_{13/15}$ oxo alcohol 0.25 | 0.8 |
| 8 | 3 | MA/styrene 30/70 | $C_{12/14}$ oxo alcohol 0.3 | 0.5 |
| 9 | 4 | MA 100 | Tallowamine 0.5 | 0.75 |
| 10 | 4 | MA 100 | Tridecylamine 0.25 | 0.8 |
| 11 | 5 | MA/isobutene 50/50 | $C_{13/15}$ oxo alcohol 0.25 | 0.5 |
| 12 | 5 | MA/isobutene 50/50 | 2-Ethylhexanol 0.5 | 0.5 |
| 13 | 1 | MA/vinyl acetate 50/50 | Oleyl alcohol 0.4 | 0.5 |
| 14 | 4 | MA 100 | $CH_3$-O-$(C_4H_8O)_{10}$H 1.0 | 0.5 |

TABLE-continued

| Ex. No. | Polymer A of Ex. No. | Polymer composition (mol %) | Amine/Alcohol B (mol per mole of MA) | NaOH per (mol mole of MA) |
|---|---|---|---|---|
| | | Dispersions of reaction products of A and B | | |
| 15 | 4 | MA 100 | $CH_3$-O-$(C_4H_8O)_{15}H$ 0.5 | 0.5 |
| 16 | 4 | MA 100 | $C_6B_{13}$-O—$C_2H_5O$-$(C_3H_6O)_{34}H$ 1.0 | 0.5 |
| 17 | 1 | MA/vinyl acetate 50/50 | $CH_3$-O-$(C_4H_8O)_{9.3}H$ 1.0 | 0.5 |
| 18 | 2 | MA/styrene 50/50 | $CH_3$-O-$(C_4H_8O)_5H$ 1.0 | 0.5 |
| 19 | 5 | MA/isobutene 50/50 | $CH_3$-O-$(C_4H_8O)_{10}H$ 1.0 | 0.5 |
| 20 | 2 | MA/styrene 50/50 | $C_4H_9$-O-$(C_2H_5O)_{22}$-$(C_3H_6O)_{13}H$ 0.5 | 0.5 |

Note: $C_4H_8O$ in Examples 14, 15, 17, 18 and 19 is oxybutylene, obtained by reaction of methanol with butylene oxide

USE EXAMPLES

EXAMPLE 21

Chrome tanned cattlehide leather which had a shaved thickness of 1.8 mm and had been adjusted to a pH of 5.0 was drummed with 15% of the product of Example 6, based on the shaved weight, at 40° C. for 2 hours. The total liquor length was 150%. The leather was then dyed with 1% of a conventional anionic aniline dye. It was then adjusted to pH 3.8 with formic acid. It was finally washed, mechanically set out and dried. The leather obtained was very soft, supple, highly filled and uniform in color.

EXAMPLE 22

Chrome tanned cattlehide leather which had a shaved thickness of 1.8 mm and had been adjusted to a pH of 5.0 and dyed with 0.7% of a conventional anionic aniline dye was drummed with 20% of the product of Example 7, based on the shaved weight, at 40° C. for 1.5 hours. Thereafter the leather was adjusted with formic acid to a pH of 3.6 and finished in a conventional manner. The leather thus obtained was very soft and pliable.

EXAMPLE 23

Chrome tanned cattlehide leather which had a shaved weight of 1.8 mm and which had been adjusted to pH 5.0 and dyed with 0.7% of a conventional anionic aniline dye was drummed with 15% of the product of Example 8, based on the shaved weight, at 40° C. for 30 minutes and then further treated with 3% of a conventional synthetic tanning agent for one hour. The leather was then adjusted with formic acid to pH 3.6 and finished in a conventional manner. The leather thus obtained had a pleasantly soft and pliable feel.

EXAMPLE 24

The product of Example 9 was used as per the procedure described in Example 21. The leather thus obtained had soft and round hand properties.

EXAMPLE 25

The product of Example 10 was used as per the procedure described in Example 23. The leather thus obtained had a round, soft hand.

EXAMPLES 26 to 28

The products of Examples 11 to 13 were used as per the procedure described in Example 22. The results were similar to those of the preceding examples.

EXAMPLES 29 to 33

The products of Examples 14 to 18 were used as per the procedure described in Example 21. The results were similar to those of the preceding examples.

EXAMPLES 34 and 35

The products of Examples 19 and 20 were used as per the procedure described in Example 23. The results were similar to those of the preceding examples.

We claim:

1. A process for fatliquoring and filling leather and fur skins, which comprises treating leather with a polymeric fatliquoring agent, the polymers thereof consisting essentially of reaction products of A) homo- or copolymers based on monoethylenically unsaturated dicarboxylic anhydrides, with the exception of sulfonated polymers, and obtainable by free-radically initiated polymerization of monomers consisting essentially of a) from 30 to 100 mol % of one or more monoethylenically unsaturated dicarboxylic anhydrides of from 4 to 10 carbon atoms, b) from 0 to 70 mol % of one or more aromatic vinyl compounds of the general formula I

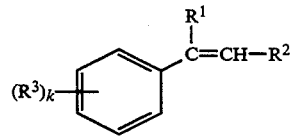

I where $R^1$, $R^2$ and $R^3$ are each hydrogen, methyl or ethyl and k is 1 or 2, (c) from 0 to 70 mol % of one or more vinyl esters of $C_1$ to $C_4$-carboxylic acids, (d) from 0 to 50 mol % of one or more $C_2$- to $C_6$-olefins, and (e) from 0 to 30 mol % of one or more monoethylenically unsaturated $C_3$- to $C_5$-carboxylic acids, which mixture of monomers (a) to (e) may additionally contain up to 10% by weight of further copolymerizable monomers, with B) amines of the general formula $R^4R^5NH$, where $R^4$ is hydrogen, $C_1$- to $C_{20}$-alkyl, $C_5$- to $C_8$-cycloalkyl or $C_2$- to $C_4$-hydroxyalkyl and $R^5$ is $C_6$- to $C_{30}$-alkyl, $C_6$- to $C_{30}$-alkenyl, $C_{15}$-to $C_8$-cycloalkyl or $C_2$- to $C_4$-hydroxyalkyl, or alcohols of the general formula $R^6—O—(C_mH_{2m}O)_p—(C_nH_{2n}O)_q—H$, where $R^6$ is $C_1$- to $C_{30}$-alkyl, $C_2$- to $C_{30}$-alkenyl, $C_5$- to $C_8$-cycloalkyl or—if $p+q>0$—hydrogen, m and n are each from 2 to 4 and p and q are each from 0 to 50, or mixtures of such amines and alcohols; to form carboxamide or carboxylic ester or mixed carboxamide and carboxylic ester-containing polymers.

2. A process as set forth in claim 1 wherein the reaction products were prepared using as component A a homopolymer of a monoethylenically unsaturated dicarboxylic anhydride of from 4 to 10 carbon atoms (a).

3. A process as set forth in claim 1 wherein the reaction products were prepared using as component A a copolymer of monomers consisting essentially of (a) from 30 to 99 mol % of a monoethylenically unsaturated dicarboxylic anhydride of from 4 to 10 carbon atoms, and (b) from 1 to 70 mol % of one or more aromatic vinyl compounds I.

4. A process as set forth in claim 1 wherein the reaction products were prepared using as component A a copolymer of monomers consisting essentially of (a) from 30 to 99 mol % of a monoethylenically unsaturated dicarboxylic anhydride of from 4 to 10 carbon atoms, and (c) from 1 to 70 mol % of one or more vinyl esters of $C_1$- to $C_4$-carboxylic acids.

5. A process as set forth in claim 1 wherein the reaction products were prepared using as component A a copolymer of monomers consisting essentially of (a) from 50 to 99 mol % of a monoethylenically unsaturated dicarboxylic anhydride of from 4 to 10 carbon atoms, and (d) from 1 to 50 mol % of one or more $C_2$- to $C_6$-olefins.

6. A process as set forth in claim 1 wherein the reaction products were prepared using maleic anhydride as monomer (a) for polymer A.

7. A process as set forth in claim 1 wherein the reaction products were prepared using as component B amines where $R^4$ is hydrogen and $R^5$ is $C_{10}$- to $C_{22}$-alkyl or $C_{10}$- to $C_{22}$-alkenyl.

8. A process as set forth in claim 1 wherein the reaction products were prepared using as component B alcohols where $R^6$ is $C_1$- to $C_{22}$-alkyl or $C_{10}$- to $C_{22}$-alkenyl, m and n are each from 2 to 4 and p and q are each from 0 to 35.

* * * * *

UNITED STATES PATENT AND TRADEMARK OFFICE

CERTIFICATE OF CORRECTION

PATENT NO. : 5,433,752

DATED : July 18, 1995

INVENTOR(S) : Hermann BIRKHOFER, et al.

It is certified that error appears in the above-indentified patent and that said Letters Patent is hereby corrected as shown below:

On the title page, Item [54] and Column 1, Lines 2-7, the title should read:

--USE OF REACTION PRODUCTS OF HOMO- OR COPOLYMERS BASED ON MONOETHYLENICALLY UNSATURATED DICARBOXYLIC ANHYDRIDES WITH AMINES OR ALCOHOLS FOR FATLIQUORING AND FILLING LEATHER AND FUR SKINS--

Signed and Sealed this

Fifth Day of September, 1995

*Attest:*

*Attesting Officer*

Bruce Lehman

BRUCE LEHMAN

*Commissioner of Patents and Trademarks*